US010081988B2

(12) United States Patent
Bergan et al.

(10) Patent No.: US 10,081,988 B2
(45) Date of Patent: Sep. 25, 2018

(54) HEAVE COMPENSATION WINCHES

(71) Applicant: Cameron Sense AS, Kristiansand (NO)

(72) Inventors: Håkon F. Bergan, Kristiansand (NO); Bård H. Kaasin, Gvarv (NO); Joe R. Berry, Cypress, TX (US); Alv Repstad, Sønge (NO)

(73) Assignee: CAMERON SENSE AS, Kristiansand (NO)

( * ) Notice: Subject to any disclaimer, the term of this patent is extended or adjusted under 35 U.S.C. 154(b) by 886 days.

(21) Appl. No.: 14/304,748

(22) Filed: Jun. 13, 2014

(65) Prior Publication Data

US 2015/0361736 A1 Dec. 17, 2015

(51) Int. Cl.

| | |
|---|---|
| ***E21B 19/00*** | (2006.01) |
| ***B66D 1/22*** | (2006.01) |
| ***B66D 1/52*** | (2006.01) |
| ***E21B 19/09*** | (2006.01) |

(52) U.S. Cl.

CPC ..... *E21B 19/006* (2013.01); *B66D 1/22* (2013.01); *B66D 1/52* (2013.01); *E21B 19/09* (2013.01)

(58) Field of Classification Search

CPC .. B66D 1/22; B66D 1/225; B66D 1/52; E21B 19/006; E21B 19/09

See application file for complete search history.

(56) References Cited

U.S. PATENT DOCUMENTS

| | | | | |
|---|---|---|---|---|
| 5,520,369 | A * | 5/1996 | Chatard | B66C 13/02 254/277 |
| 5,894,895 | A | 4/1999 | Welsh | |
| 6,926,103 | B1 | 8/2005 | Roodenburg et al. | |
| 6,926,260 | B1 | 8/2005 | De Groot et al. | |
| 6,932,325 | B1 * | 8/2005 | Selcer | B66C 13/02 212/308 |
| 7,934,561 | B2 | 5/2011 | Ormond | |
| 9,056,751 | B2 | 6/2015 | Roodenburg et al. | |
| 9,140,079 | B2 | 9/2015 | Pohner | |
| 2011/0036085 | A1 | 2/2011 | Oigarden | |
| 2012/0034061 | A1 | 2/2012 | Boroy | |

FOREIGN PATENT DOCUMENTS

| | | | | |
|---|---|---|---|---|
| CN | 102943636 | A | 2/2013 | |
| CN | 203476248 | U | 3/2014 | |
| CN | 102691484 | B | 4/2014 | |
| GB | 2055342 | A * | 3/1981 | B66D 1/52 |
| WO | WO 8500581 | A1 * | 2/1985 | B63B 23/48 |
| WO | 2013/076207 | A2 | 5/2013 | |
| WO | 2015007412 | | 1/2015 | |

* cited by examiner

*Primary Examiner* — Sang K Kim
*Assistant Examiner* — Nathaniel L Adams
(74) *Attorney, Agent, or Firm* — Helene Raybaud

(57) ABSTRACT

Various hoisting systems with heave compensation are provided. In one embodiment, an apparatus includes a winch having a rotatable drum and a heave compensation system with both active and passive drive input devices. The heave compensation system can be coupled to the rotatable drum so that the active and passive drive input devices can each be used to drive rotation of the rotatable drum in response to heaving motion of the winch. Additional systems, devices, and methods are also disclosed.

16 Claims, 7 Drawing Sheets

HEAVE COMPENSATION WINCHES

BACKGROUND

This section is intended to introduce the reader to various aspects of art that may be related to various aspects of the presently described embodiments. This discussion is believed to be helpful in providing the reader with background information to facilitate a better understanding of the various aspects of the present embodiments. Accordingly, it should be understood that these statements are to be read in this light, and not as admissions of prior art.

In order to meet consumer and industrial demand for natural resources, companies often invest significant amounts of time and money in finding and extracting oil, natural gas, and other subterranean resources from the earth. Particularly, once a desired subterranean resource such as oil or natural gas is discovered, drilling and production systems are often employed to access and extract the resource. These systems may be located onshore or offshore depending on the location of a desired resource.

Floating drilling platforms are sometimes used for offshore drilling operations and include a hoisting system for raising and lowering equipment, such as a drill string, to a subsea wellsite. Because these platforms float at the surface of the water and are not anchored to the seabed with legs, the platforms can vertically rise and fall (i.e., heave) with waves in the water. Heave compensation can be used to counteract the vertical heaving motion and reduce movement of the drill string or other hoisted load with respect to the seabed.

Various types of heave compensators have been used in an effort to maintain a constant weight on bit for a hoisted drill string and reduce deviation of the drill string with respect to the seabed as the drilling platform rises and falls with the waves. Simple heave compensators acting as shock absorbers have been provided between traveling blocks and drill strings hoisted with a drawworks system. Active heave compensation has also been used, in which heaving motion of the drilling platform is measured and used to actively control the position of the drill string.

As operators have moved to deeper waters and deeper wells, the weight of the equipment to be hoisted by offshore rigs (e.g., drill strings, casing strings, and wellhead equipment) has increased. Multi-part block-and-tackle arrangements have been used with drawworks for hoisting on drilling rigs, in which hoisting lines are reeved through sheaves of crown and traveling blocks to provide a mechanical advantage. One approach to increasing the hoisting capabilities of such arrangements is to add more lines and sheaves and increase the size of the hoisting lines. Drilling platforms have also been provided as hydraulically driven "cylinder rigs," which use large hydraulic cylinders instead of drawworks. The hydraulic cylinders in such rigs can provide both the main hoisting function and a heave compensating function.

SUMMARY

Certain aspects of some embodiments disclosed herein are set forth below. It should be understood that these aspects are presented merely to provide the reader with a brief summary of certain forms the invention might take and that these aspects are not intended to limit the scope of the invention. Indeed, the invention may encompass a variety of aspects that may not be set forth below.

Embodiments of the present disclosure generally relate to hoisting systems having heave compensation functions. In certain embodiments, hoisting systems include both active heave compensation at drawworks (or winches) of the systems and passive heave compensation. And in at least some embodiments, active heave compensation and passive heave compensation are provided at a winch that includes a planetary gear system, which allows both active and passive heave compensation to be applied to a rotating drum of the winch.

Various refinements of the features noted above may exist in relation to various aspects of the present embodiments. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. Again, the brief summary presented above is intended only to familiarize the reader with certain aspects and contexts of some embodiments without limitation to the claimed subject matter.

BRIEF DESCRIPTION OF THE DRAWINGS

These and other features, aspects, and advantages of certain embodiments will become better understood when the following detailed description is read with reference to the accompanying drawings in which like characters represent like parts throughout the drawings, wherein.

DETAILED DESCRIPTION OF SPECIFIC EMBODIMENTS

Specific embodiments of the present disclosure are described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments, the articles "a," "an," "the," and "said" are intended to mean that there are one or more of the elements. The terms "comprising," "including," and "having" are intended to be inclusive and mean that there may be additional elements other than the listed elements. Moreover, any use of "top," "bottom," "above," "below," other directional terms, and variations of these terms is made for convenience, but does not require any particular orientation of the components.

Figure 1:
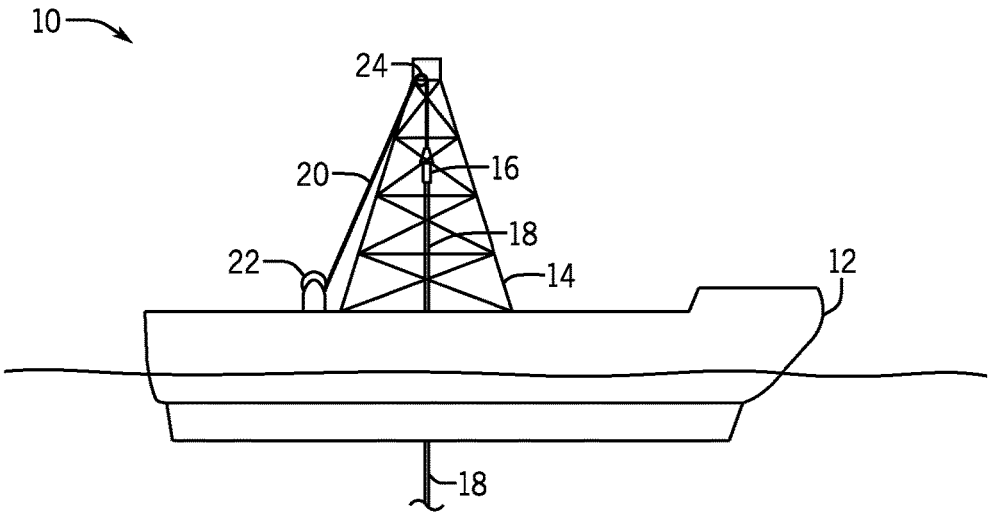
FIG. 1 generally depicts a floating drilling rig with a hoisting system in accordance with one embodiment of the present disclosure.

Turning now to the present figures, a system 10 is illustrated in FIG. 1 in accordance with one embodiment. In this example, the system 10 is an offshore drilling rig in the form of a floating vessel 12. More specifically, the floating vessel 12 is generally depicted as a drillship in FIG. 1, but the floating vessel could be provided in another form, such as a semi-submersible drilling rig, in other embodiments.

The vessel 12 includes a hoisting system for raising and lowering equipment with respect to a drill floor of the vessel, which facilitates well drilling and completion operations. The depicted hoisting system includes a derrick 14 constructed on the drill floor of the vessel 12. Various equipment and other loads can be supported by one or more hoisting lines 20 of the hoisting system. In FIG. 1, the supported load includes a top drive 16 and a drill string 18 suspended from the top drive 16. The drill string 18 extends through a hole in the drill floor of the vessel 12 and can be rotated by the top drive 16 to facilitate drilling of a subsea well. It will be appreciated that the hoisting system could be used for hoisting other loads, such as casing strings, wellhead equipment, and other subsea well components.

The hoisting system includes a drawworks 22, which can be provided on the drill floor with the derrick 14, as shown in FIG. 1, or at another location. The drawworks 22 includes a rotatable drum 26 (FIG. 2) that can reel in and reel out the hoisting line (or lines) 20 wound on the rotatable drum. Each hoisting line 20 can be reeved over a sheave in a crown block 24 coupled to the derrick 14 and connected to the supported load so that the reeling in and reeling out of the hoisting line 20 via the drum 26 raises and lowers the supported load.

Figure 2:
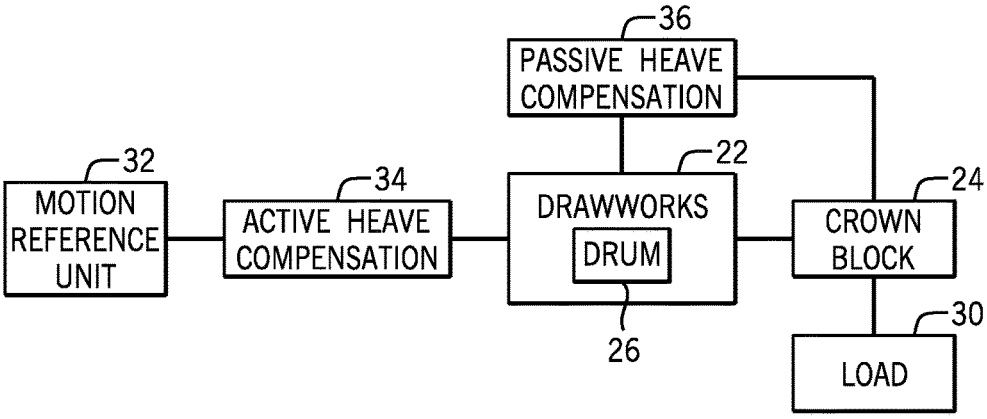
FIG. 2 is a block diagram representing a hoisting system having both active and passive heave compensation functions in accordance with one embodiment.

In at least some embodiments, the hoisting system includes both active heave compensation and passive heave compensation to compensate for heaving motion of the floating vessel 12 from wave action at the surface of the water. One such embodiment is generally depicted in FIG. 2 by way of example. In this figure, a load 30 is supported by a hoisting system including the crown block 24 and the drawworks 22 with the rotatable drum 26. As described above, one or more hoisting lines 20 can be wound from the drum 26 and reeved over the crown block 24 to support a given load 30. Although not depicted here, it is noted that the hoisting lines 20 can be coupled to the load 30 by a traveling block suspended from the crown block 24 with the hoisting lines 20. But the traveling block is omitted in some embodiments.

As the load 30 is suspended from the crown block 24 with the hoisting lines 20, heave of the vessel 12 causes the load 30 to move up and down with respect to the underlying seabed. During drilling operations, such movement can cause a drill bit at the end of the drill string 18 to be pulled off the bottom of the well (with upward heave) or to be pushed with greater force against the bottom if the well (with downward heave).

To compensate for the heaving motion and reduce deviation of the hoisted load 30 with respect to the seabed, the hoisting system in FIG. 2 includes an active heave compensation system 34 and a passive heave compensation system 36. A motion reference unit 32 can be used to detect the heave of the vessel 12. In at least some embodiments, the active heave compensation system 34 uses the measured heave to actively compensate for heaving motion through control of the drawworks 22. For instance, the active heave compensation system 34 can include a controller (e.g., a programmable logic controller or a programmed general-purpose computer) that receives the measured heave as an input and controls operation of the drawworks 22 to raise and lower the load 30 (with respect to the drill floor) to compensate for the heaving motion. The controller can control operation in any suitable manner, such as by sending command signals to motors of the drawworks 22 that control rotation of the drum 26. These motors can be considered part of the active heave compensation system 34 as well.

The passive heave compensation system 36 can also be used to counter heaving motion of the vessel 12. In contrast to the active heave compensation system 34, the passive heave compensation system 36 can counter heave without requiring external power. For example, the passive heave compensation system 36 can include one or more hydraulic devices (e.g., hydraulic cylinders or hydraulic motors) that passively store and release energy from the heaving motion of the vessel 12 to move the load 30 with respect to the drill floor to reduce the deviation of the load 30 from its position with respect to the seabed. In some instances, the passive heave compensation system 36 could also include an active component (e.g., a hydraulic cylinder that passively compensates for heave and that can also be actively driven for further heave compensation).

Various examples of hoisting systems having both active and passive heave compensation are described in U.S. patent application Ser. No. 14/304,728, which was filed on Jun. 13, 2014, and at the time of filing was entitled "Hoisting Systems with Heave Compensation," named Erling Tambs et al. as inventors; that application is hereby incorporated by reference in its entirety. In some instances of the present technique, such as those described below with respect to FIGS. 3-9, hoisting systems include drawworks or winches having both active and passive heave control. While the winches described below could be used as a drawworks on a drilling rig, it is noted that the winches could also or instead be used in other applications (e.g., in hoisting systems on other vessels not used for drilling, or on floating docks).

Figure 3:
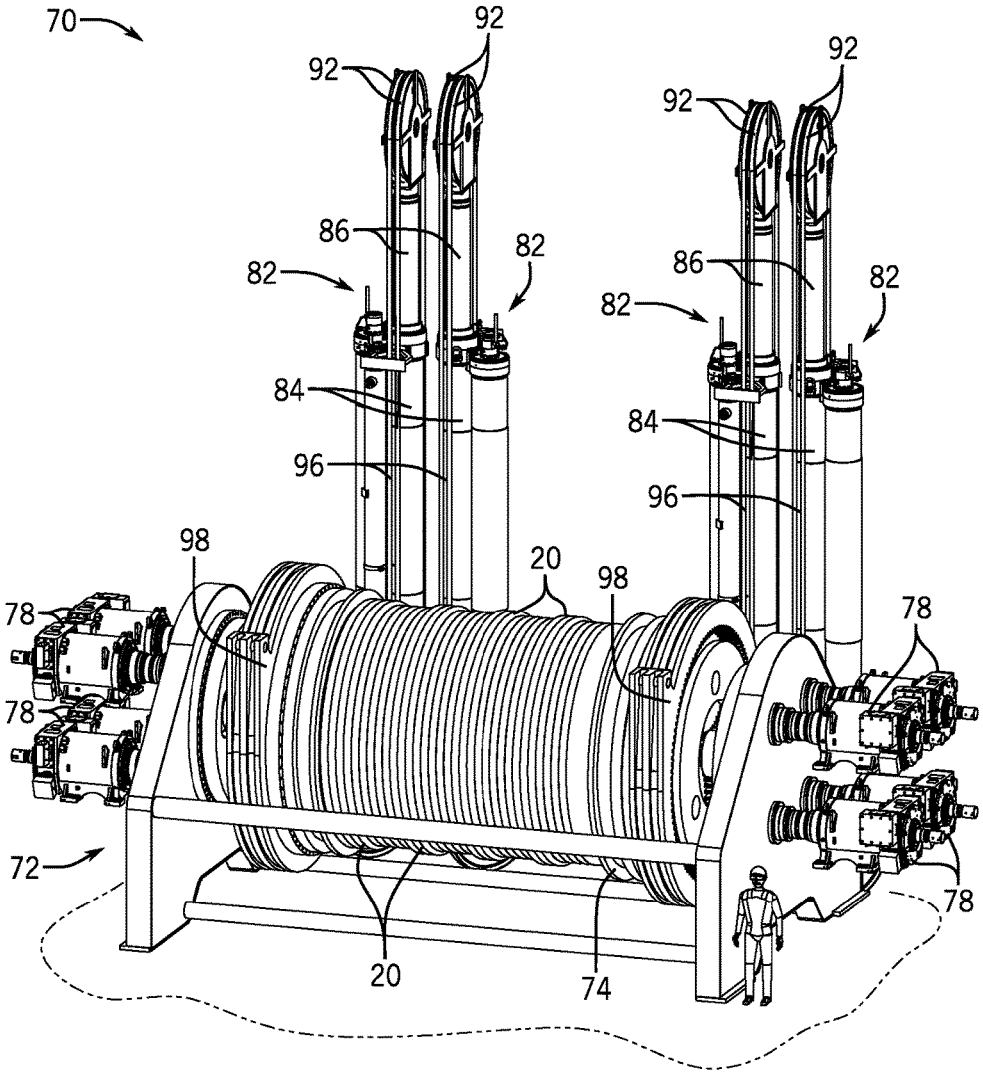
FIG. 3 is a front perspective view of a winch having both active and passive heave compensation in accordance with one embodiment.

In FIG. 3, a depicted heave-compensated system 70 includes a drawworks or winch 72 having a rotatable drum 74 mounted on a frame. Hoisting lines 20 are wound on the drum 74. Although omitted here for the sake of clarity, it will be appreciated that portions of the hoisting lines 20 extend from the drum 74 and can be used to support a hoisted load. In some instances the winch 72 could be used with a crown block and a derrick, but in other embodiments the winch 72 could be used without one or both of those additional components. Further, the hoisting lines 20 can be provided as single-part lines (rather than multi-part lines) for supporting the hoisted load.

Motors 78 can be operated to drive rotation of the drum 74 to reel in or reel out the hoisting lines 20 to raise and lower an attached load 30. Any suitable motors 78 could be used. The motors 78 can include electric motors, for example. The motors 78 can also provide active heave control via the drum 74, in which case the motors are actively controlled to compensate for heave as generally described above.

Passive heave compensation can be applied to the winch 72 by hydraulic cylinders 82. These cylinders 82 are depicted with cylinder housings 84 with extendable rods 86 connected to sheaves 92. In at least some instances, other sheaves are coupled below the cylinders 82. In one embodiment, the hydraulic cylinders 82 are provided in a jigger winch assembly with tension lines 96 to rotate a ring gear 98 of a planetary gear system of the winch 72, although other arrangements could instead be used.

Figure 4:
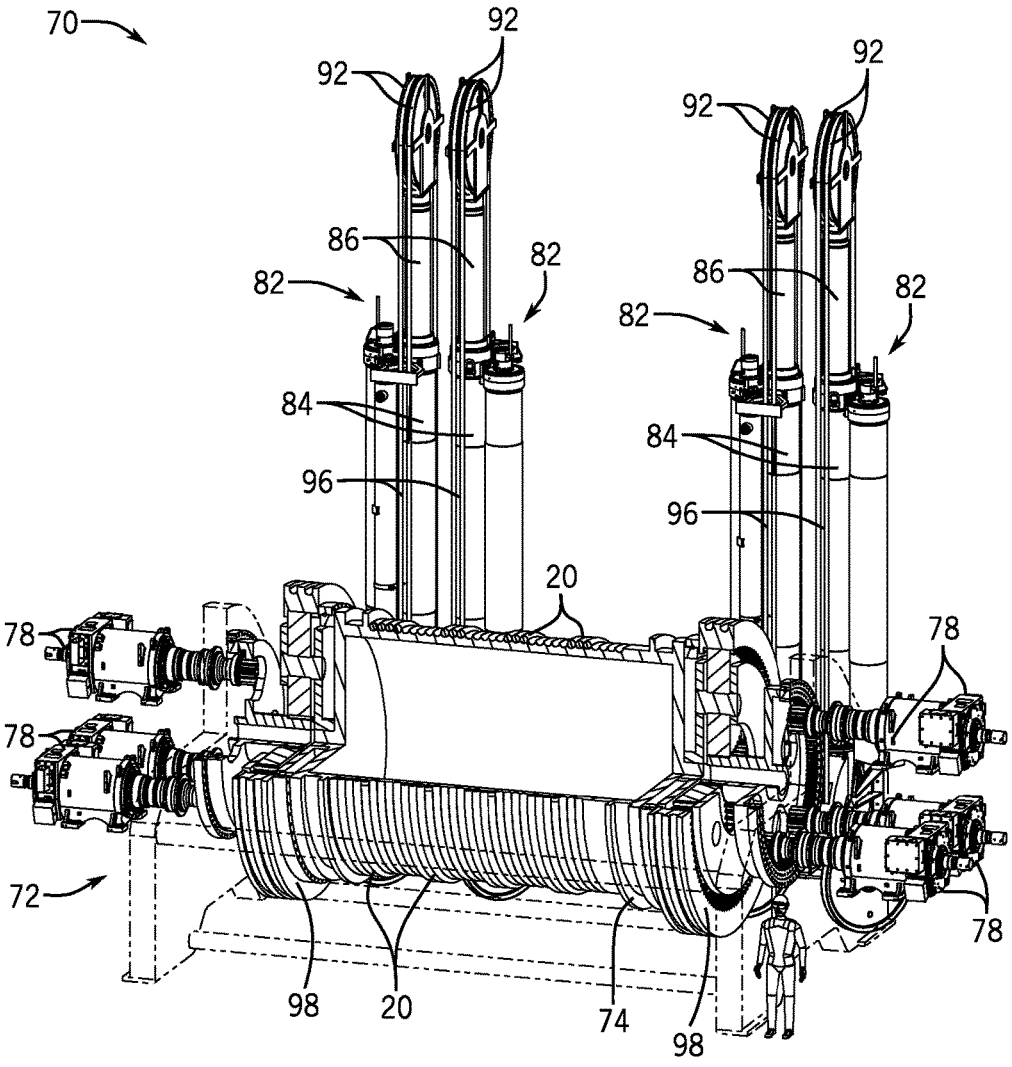
FIG. 4 is a sectioned view of the winch of FIG. 3.
Figure 5:
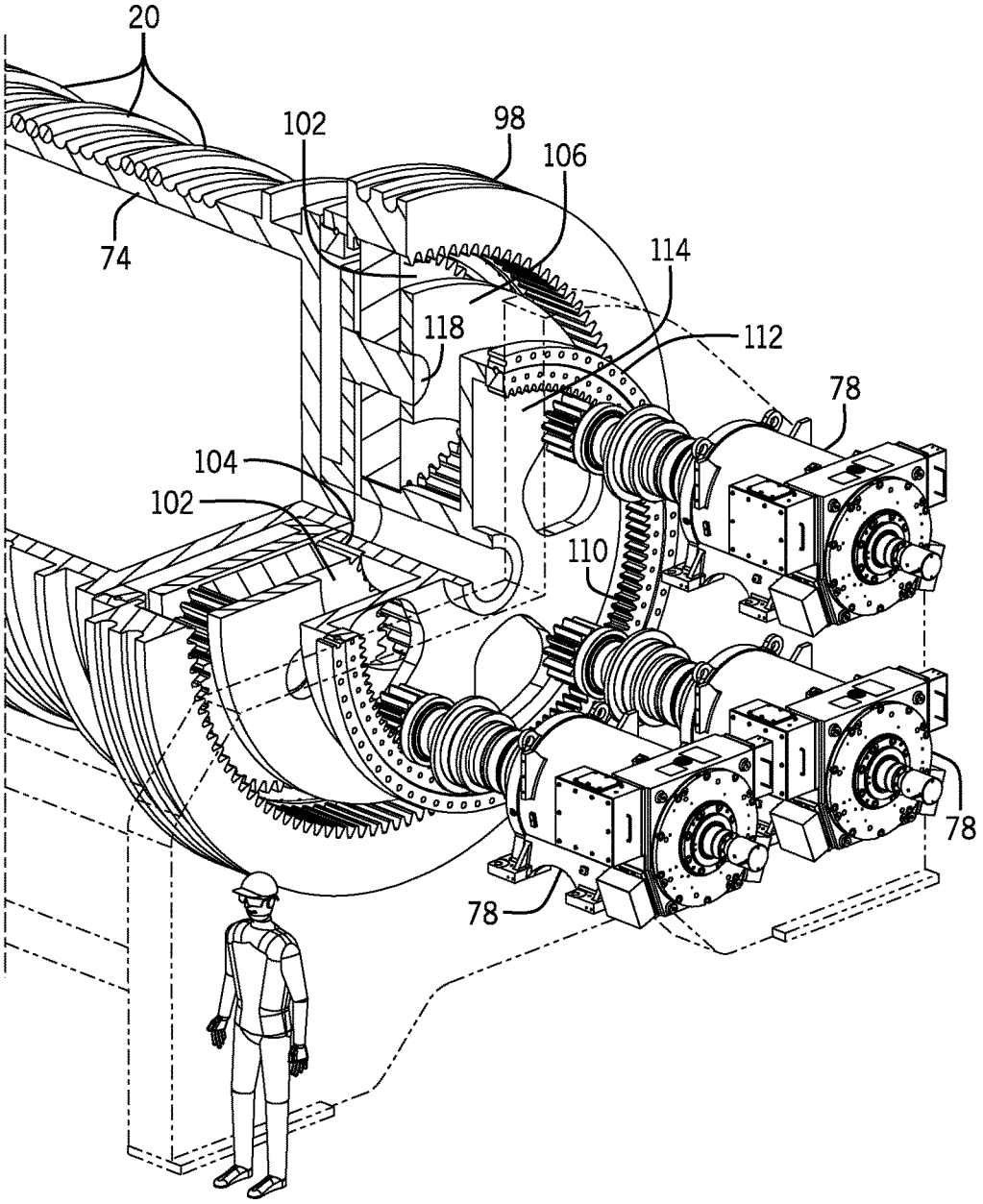
FIG. 5 is a detail view of the sectioned winch of FIG. 4 and shows a planetary gear system for driving rotation of a drum of the winch in accordance with one embodiment.
Figure 6:
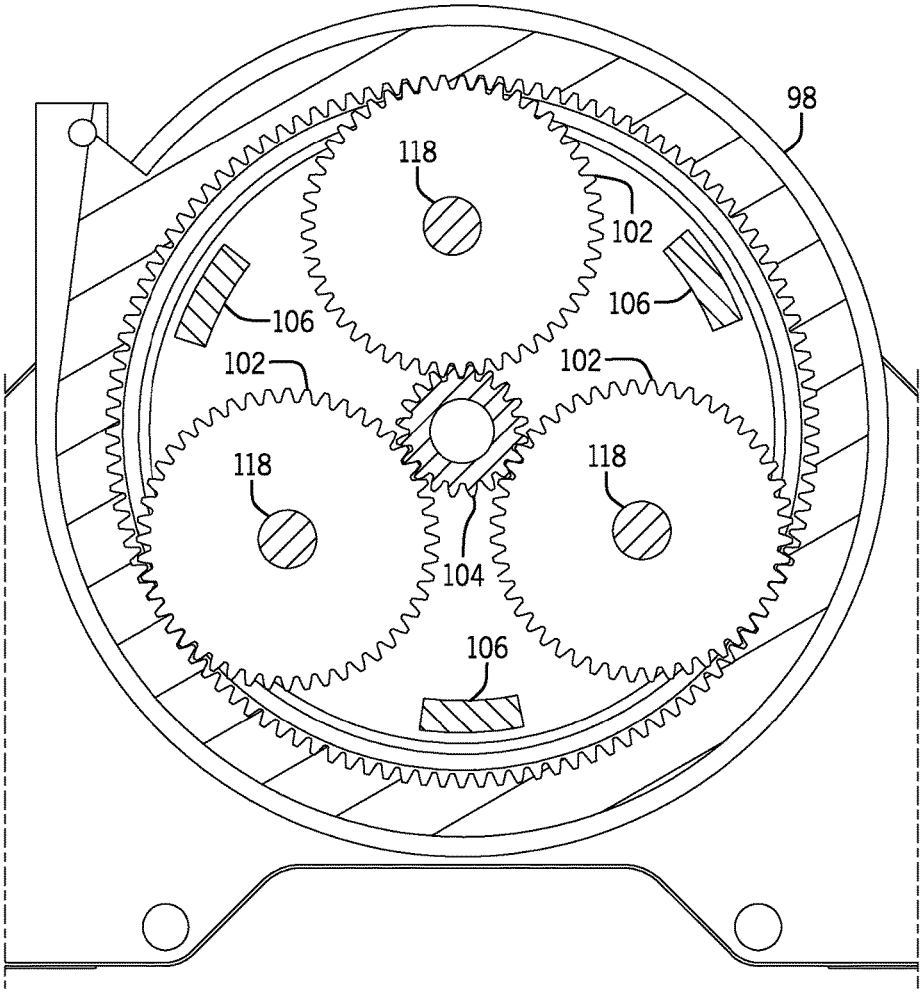
FIG. 6 is a cross-section of the winch of FIG. 4 showing planetary gears disposed between a sun gear and a ring gear in accordance with one embodiment.

As generally shown in FIG. 4 and more specifically shown in FIGS. 5 and 6, the planetary gear system includes the ring gear 98, planetary gears 102, and a sun gear 104. A carrier 106 is coupled to rotate with the planetary gears 102 as they orbit the sun gear 104 in operation. In this embodiment, the active drive system (here the motors 78, which provide both a primary hoisting function and active heave compensation) is connected to drive the sun gear 104. More specifically, the motors 78 are connected to drive rotation of a gear 110 of a slew bearing 112. The gear 110 is coupled to a sun wheel 114 having the sun gear 104 such that the motors 78 rotate the sun gear 104 via the wheel 114 and the gear 110. The planetary gears 102 are mounted on axles 118 coupled to the carrier 106, which is coupled to drive the drum 74. This allows the orbit of the planetary gears 102 to drive rotation of both the carrier 106 and the drum 74.

In this embodiment, the passive heave compensation system (here including the cylinders 82) is connected to the ring gear 98. This allows a combination of active and passive adjustment of the rotational position of the drum 74 through a differential regulation principle. In the embodiment depicted in FIG. 5, active heave compensation varies rotation of the sun gear 104 and passive heave compensation varies rotation of the ring gear 98. Rotation of the sun gear 104 and the ring gear 98 causes the planetary gears 102 to rotate and orbit about the sun gear 104. The carrier 106 is coupled to drive rotation of the drum 74 in response to the orbit of these planetary gears 104, as noted above.

Figure 7:
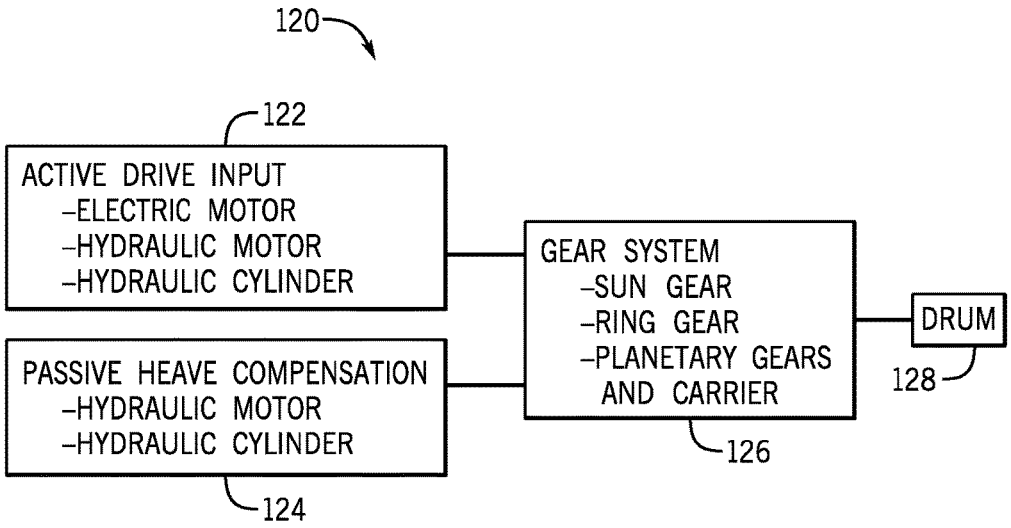
FIG. 7 is a block diagram of various active drive inputs and passive heave compensation systems that can be connected to a gear system to drive rotation of a drum of a winch in accordance with various embodiments.

Various active and passive components can be used to drive rotation of different elements of the planetary gear system. As shown in FIG. 7 in accordance with some embodiments, differential heave compensation systems 120 include active drive input devices 122 (which can have active heave compensation) and passive heave compensation devices 124 (which can also be considered passive drive input devices) coupled to elements of planetary gear systems 126 to drive rotation of a drum 128. The system 70 depicted in FIGS. 3-6 is one example of a differential heave compensation system 120, with motors 78 coupled to the sun gear 104 as the active drive input devices 122, hydraulic cylinders 82 coupled to the ring gear 98 as the passive heave compensation devices 124, and a drum 74 coupled to the planetary gears 102 and carrier 106. But other active and passive drive devices could be used. For example, the active drive input devices 122 can include actively driven hydraulic motors or hydraulic cylinders, and the passive heave compensation devices 124 can include a passively operating hydraulic motor. Further, although certain embodiments may have single-part lines reeled in and out from a drum, the differential heave compensation systems 120 can be used in embodiments using single-part lines or other embodiments having multi-part lines.

Moreover, the active devices 122, the passive devices 124, and the drum 128 could be connected to the ring gear, sun gear, and the set of planetary gears in any combination. It is noted that there are six permutations of coupling each of the active devices 122, the passive devices 124, and the drum 128 with one of the ring gear, the sun gear, and the planetary gears of the gear set 126. For instance, the connections of the active drive devices 122 and the passive heave compensation devices 124 could be switched from the arrangement of system 70, with the active devices 122 coupled to the ring gear and the passive devices 124 coupled to the sun gear. In other embodiments, the drum 128 could be connected to the sun gear or the ring gear instead of the planetary gears, which could be driven by the active devices 122 or the passive devices 124. Although these embodiments use a differential system on a planetary gear arrangement principle, a regular differential may also be used (e.g., in the case of passive and active drive inputs each being provided by motors).

The differential system with a planetary gear arrangement can be used to hoist a load by rotating the drum 128. The system can be considered to have two types of mechanical input (active drive and passive drive) and one mechanical output (to rotate the drum). The differential can be controlled in such way that drum motion is from active input alone, from passive input alone, or from the simultaneous combination of both inputs. Drum movement is then controlled by the sum of any moving inputs. It is noted that the drum can have either one or more wire ropes or chains, and might have one or more layers. Drum output speed varies dependent on direct acting hoisting or via block-and-tackle systems.

A passive drive input can be characterized as one that does not require an external power source to be able to perform the desired motion compensation. If the compensation is taken care of by the passive side, rig power consumption is at a minimum. A semi-active system is typically used when passive compensation is performed by hydraulic motors; in such cases power consumption can be used just to control displacement of motors. The passive side can also be used as a regenerative device for hoisting, in which motors are used for braking when lowering and charging accumulators and the stored energy is then used for hoisting the traveling load. The passive system can also have a parallel active system attached. This system can be used either as a performance booster while in a constant tension mode (maintaining a tension level on the hoisting line) or as an energy saver when in active heave compensation mode.

Figure 9:
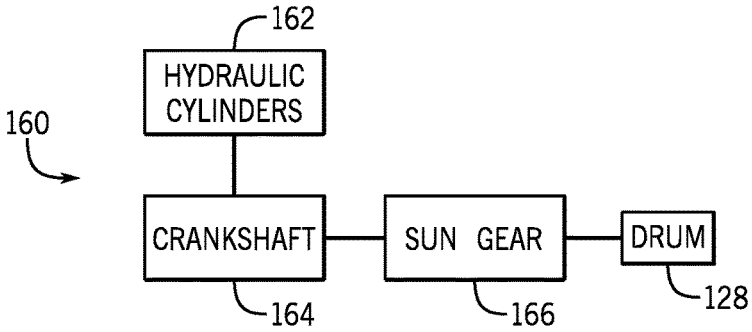
FIG. 9 is a block diagram of a sun gear that can be operated by hydraulic cylinders via a crankshaft to drive rotation of a drum of a winch in accordance with one embodiment.
Figure 8:
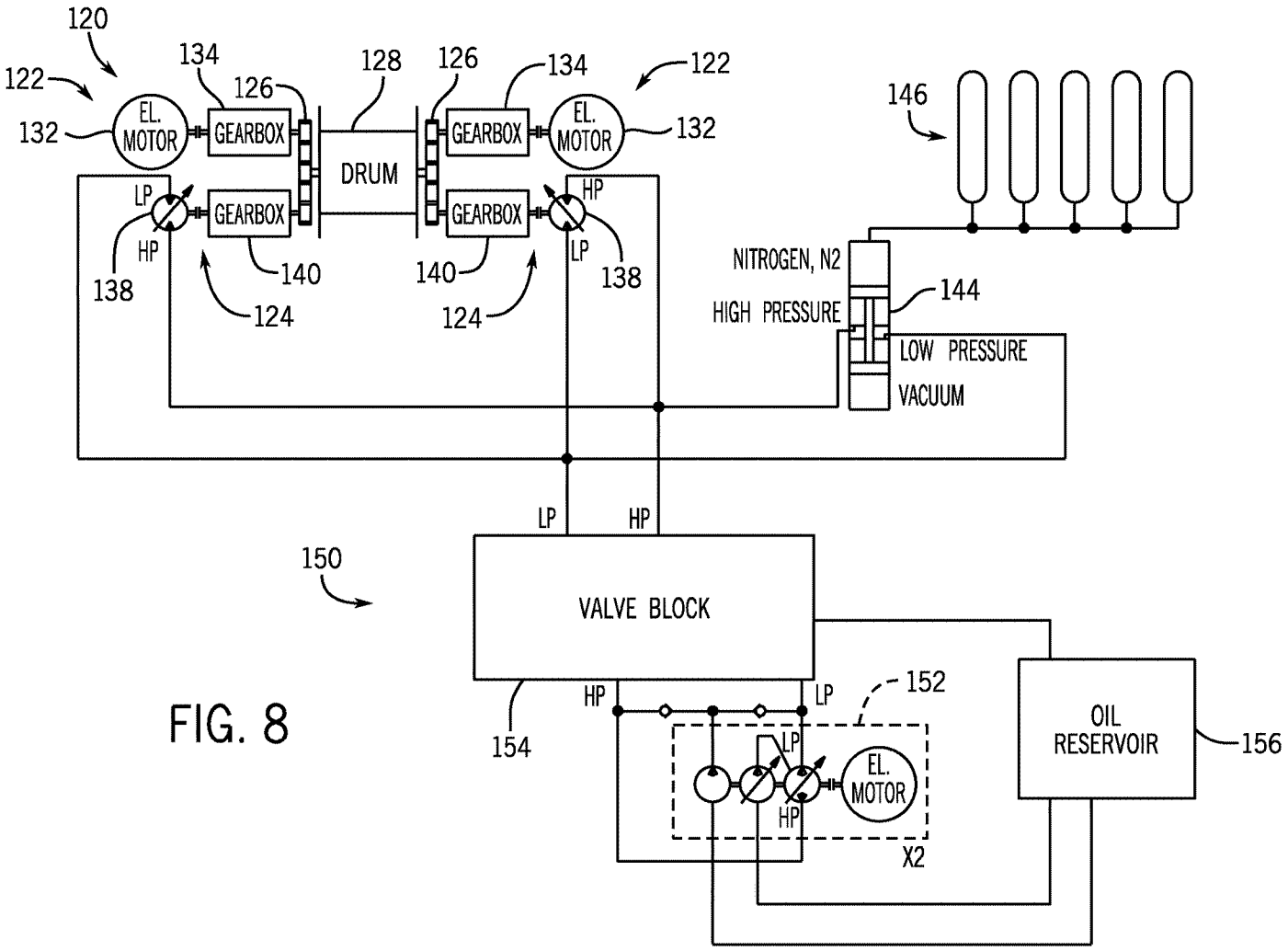
FIG. 8 is a schematic of a winch system with active heave compensation provided by electric motors and passive heave compensation provided by hydraulic motors in accordance with one embodiment.

The passive drive inputs can include any suitable devices and arrangements. For example, in some embodiments, the passive drive inputs are provided as hydraulic cylinders with wire or chain connections. In at least some instances, these wire or chain connections are passed over eccentric sheaves before entering the system to compensate for the differential in passive compensation component properties. The passive drive inputs can instead include hydraulic motors with or without a semi-active part. One example of a differential heave compensation system 120 using hydraulic motors with semi-active parts as the passive drive inputs is depicted in FIG. 8 and described in greater detail below. The passive drive inputs could also be provided by hydraulic cylinders connected to the planetary gear system with a crankshaft (as depicted in FIG. 9 and discussed below), hydraulic cylinders with an active part, or hydraulic cylinders with rack-and-pinion connections for rotation.

The active side (i.e., the active drive inputs) can be characterized as the part of the system used for hoisting, and also for active heave compensation. The active part is dependent on an external power source to drive rotation of the drum. The active drive inputs can be provided in any suitable form, such as an electric motor, a hydraulic motor, or a hydraulic cylinder. The electric and hydraulic motors provided as active drive inputs could be used with or without gearboxes and with or without brakes in various embodiments.

In some embodiments, multiple input drive devices (whether active or passive) may be used, which can provide redundancy and increased performance. By way of example, when four passive cylinders are present in a hoisting system, only two can be used if compensating lower loads to increase performance (from an accumulator bank for the four cylinders being made available to only half of the cylinders).

A further example of a differential heave compensation system 120 is depicted in FIG. 8. In this example, the system 120 includes active drive input devices 122 in the form of electric motors 132 coupled to planetary gear systems 126 via gearboxes 134. The system 120 depicted here also includes passive heave compensation devices 124 in the form of variable displacement hydraulic motors 138 coupled to the planetary gear systems 126 via gearboxes 140. In other embodiments, the gearboxes 134 and 140 could be omitted. The ring gear of the gear system 126 can be provided with external teeth, and the hydraulic motors 138 can act on the ring gear via the external teeth to provide passive heave compensation. The hydraulic motors 138 act as hydraulic pumps to absorb the energy from the hoist when the vessel heaves upward and act as motors (turning the opposite direction) when the vessel heaves downward.

A hydraulic accumulator 144 is connected to the hydraulic motors 138 and to gas storage bottles 146. In the system 70 described above, similar gas storage bottles attached to the hydraulic cylinders 82 provide the volume allowing the extension and retraction of the cylinder rods 86 for passive heave compensation. The compensating load value is regulated by increasing or decreasing the charge pressure (e.g., of nitrogen) in these storage volumes. In the embodiment shown here in FIG. 8, however, the compensating load value is regulated by changing the displacement of the hydraulic motors 138 while maintaining a constant charge pressure in the gas storage bottles 146.

The compensation system 120 in FIG. 8 includes a hydraulic power system 150 for actively controlling displacement of the hydraulic motors 138. The hydraulic power system 150 can include one or more main power units 152 that draw hydraulic fluid from a reservoir 156 and route the hydraulic fluid through a valve block 154 to the hydraulic motors 138. In passive cylinder systems, the compensating load value changes due to the compression and decompression of the gas in the storage bottles as the cylinders extend and retract. This load variation can be negated through the use of an active set of cylinders acting on the passive cylinders. But the active cylinders could be quite large, requiring a hydraulic power unit of substantial size. In the system of FIG. 8, the displacement of the hydraulic motors can be actively increased and decreased on the fly to maintain a more constant compensating load value to negate the change in pressure in gas storage bottles 146 as the vessel heaves up and down. In this system, the main power unit 152 can be used to compensate for leakage of the hydraulic motors 138, but there would be no additional power unit demand to provide the active override to obtain a more constant compensating load value. Consequently, a smaller main power unit 152 can be used in the system of FIG. 8 compared to that of passive cylinder embodiments.

As generally noted above, in at least one embodiment passive heave compensation can be provided by one or more hydraulic cylinders via a crankshaft coupled to the planetary gear system. In FIG. 9, a passive heave compensation system 160 includes hydraulic cylinders 162 connected to drive a crankshaft 164 that is coupled to a sun gear 166 (e.g., of the planetary gear system 126). Further, the active drive input can be connected to the ring gear and the drum 128 can be connected to the set of planetary gears such that the drum 128 can be rotated by the active drive input and the passive drive input (e.g., the cylinders 162).

Though all-hydraulic cylinder rigs can be used for hoisting functions, they can have certain drawbacks, such as the complexity of the hydraulics, the size and expense of a hydraulic power unit sufficient for the rig, and the piping and cylinders required to provide both the main hoisting function (which may require about 180 feet of vertical travel) and the heave compensating system. In contrast, certain embodiments disclosed herein include an electrically driven winch or drawworks for normal hoisting functions and active heave compensation combined with a hydraulic passive heave compensating system with much less complexity than the all-hydraulic designs. This reduction in complexity enables lighter hoisting systems to be used and facilitates installation and servicing. The present systems may also have reduced power consumption compared to certain previous designs. Further, moving the passive heave compensation system to the drill floor from high in the derrick provides a lower center of gravity. And in the use of single-part lines in some embodiments enables a faster hoisting speed while maintaining a reasonable rotation speed of the drum of the winch.

While the aspects of the present disclosure may be susceptible to various modifications and alternative forms, specific embodiments have been shown by way of example in the drawings and have been described in detail herein. But it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. An apparatus comprising:

a winch including a rotatable drum and a heave compensation system having: a motion reference unit and both an active drive input device and a passive drive input device, wherein the heave compensation system is coupled to the rotatable drum such that the active drive input device and the passive drive input device can each be used to drive rotation of the rotatable drum in response to heaving motion of the winch, the motion reference unit is configured to measure the heaving motion, and the active drive input device is an active heave compensation device configured to actively compensate for the heaving motion based on a measurement of the heaving motion by the motion reference unit;

wherein the winch includes a planetary gear system and the heave compensation system is coupled to the rotatable drum via the planetary gear system to enable the planetary gear system to convert mechanical inputs from the active and passive drive input devices into mechanical output to control reeling of a hoisting line from the rotatable drum; and wherein the planetary gear system includes:

a sun gear coupled to one of the active drive input device or the passive drive input device;

a ring gear coupled to the other of the active drive input device or the passive drive input device; and one or more planetary gears coupled between the sun gear and the ring gear to be rotated by each of the sun gear and the ring gear, wherein the one or more planetary gears are coupled to the rotatable drum.

2. The apparatus of claim 1, wherein the active drive input device includes an electric motor with active heave compensation.

3. The apparatus of claim 1, wherein the passive drive input device includes a hydraulic cylinder or a hydraulic motor.

4. The apparatus of claim 1, wherein the one or more planetary gears are coupled to the rotatable drum via a carrier connected to the one or more planetary gears such that the carrier rotates and drives rotation of the rotatable drum when the one or more planetary gears orbit the sun gear.

5. The apparatus of claim 1, wherein the passive drive input device includes at least one hydraulic cylinder in a jigger winch assembly to enable the at least one hydraulic cylinder to cause rotation of the ring gear in response to heaving motion of a floating drilling vessel having the hoisting system.

6. The apparatus of claim 1, wherein the passive drive input device includes at least one hydraulic motor coupled to the ring gear via an additional gear to enable the at least one hydraulic motor to cause rotation of the ring gear via the additional gear in response to heaving motion of a floating drilling vessel having the hoisting system.

7. The apparatus of claim 1, wherein the passive drive input device includes at least one hydraulic cylinder coupled to the sun gear via a crankshaft.

8. The apparatus of claim 1, comprising at least one single-part hoisting line wound on the rotatable drum.

9. The apparatus of claim 1, comprising a hoisting system including the winch and a crown block.

10. The apparatus of claim 9, comprising a floating vessel having the hoisting system.

11. The apparatus of claim 10, wherein the floating vessel is a drillship.

12. An apparatus comprising:

a winch including a rotatable drum and a heave compensation system having both an active drive input device and a passive drive input device, wherein the heave compensation system is coupled to the rotatable drum such that the active drive input device and the passive drive input device can each be used to drive rotation of the rotatable drum in response to heaving motion of the winch;

wherein the winch includes a planetary gear system and the heave compensation system is coupled to the rotatable drum via the planetary gear system to enable the planetary gear system to convert mechanical inputs from the active and passive drive input devices into mechanical output to control reeling of a hoisting line from the rotatable drum;

wherein the planetary gear system includes:

a sun gear coupled to the active drive input device;

a ring gear coupled to the passive drive input device; and one or more planetary gears coupled to the rotatable drum; and wherein the passive drive input device includes at least one hydraulic motor coupled to the ring gear via an additional gear to enable the at least one hydraulic motor to cause rotation of the ring gear via the additional gear in response to heaving motion of a floating drilling vessel having the hoisting system; and the apparatus also includes at least one gas storage bottle coupled to the at least one hydraulic motor and a hydraulic power system coupled to the at least one hydraulic motor to enable the hydraulic power system to actively control displacement of the hydraulic motor to regulate a compensating load value of the at least one hydraulic motor while maintaining a constant pressure within the at least one gas storage bottle.

13. A method comprising:

connecting a load to a hoisting system of a floating vessel, wherein the hoisting system includes a winch having a rotatable drum and a heave compensation system having: a motion reference unit and both an active drive input device and a passive drive input device, the heave compensation system is coupled to the rotatable drum such that the active drive input device and the passive drive input device can each be used to drive rotation of the rotatable drum in response to heaving motion of the winch, the motion reference unit is configured to measure the heaving motion, the active drive input device is an active heave compensation device configured to actively compensate for the heaving motion based on a measurement of the heaving motion by the motion reference unit, the winch includes a planetary gear system, the heave compensation system is coupled to the rotatable drum via the planetary gear system to enable the planetary gear system to convert mechanical inputs from the active and passive drive input devices into mechanical output to control reeling of a hoisting line from the rotatable drum, and the planetary gear system includes:

a sun gear coupled to one of the active drive input device or the passive drive input device;

a ring gear coupled to the other of the active drive input device or the passive drive input device; and one or more planetary gears coupled between the sun gear and the ring gear to be rotated by each of the sun gear and the ring gear, wherein the one or more planetary gears are coupled to the rotatable drum;

using the hoisting system to position the load;

detecting heave of the floating vessel;

applying active heave compensation to the rotatable drum via the active drive input device based on the measurement of the heaving motion by the motion reference unit to reduce relative movement of the load with respect to a seabed below the floating vessel due to the heave; and applying passive heave compensation to the rotatable drum via the passive drive input device to reduce relative movement of the load with respect to the seabed due to the heave;

wherein the active heave compensation and the passive heave compensation are applied to the rotatable drum via the planetary gear system.

14. The method of claim 13, wherein the active heave compensation is applied to the sun gear of the planetary gear system and the passive heave compensation is applied to the ring gear of the planetary gear system.

15. The method of claim 13, wherein applying the passive heave compensation to the rotatable drum includes operating a hydraulic pump to drive a component of the planetary gear system.

16. The method of claim 13, wherein connecting the load to the hoisting system includes connecting a top drive to the hoisting system.

* * * * *